US006379080B1

(12) United States Patent
Saffo, Sr.

(10) Patent No.: US 6,379,080 B1
(45) Date of Patent: Apr. 30, 2002

(54) APPARATUS FOR LEVELING AND SMOOTHING OF CONCRETE

(76) Inventor: Richard E. Saffo, Sr., Box 11, Howe Hill Rd., Woodsville, NH (US) 03785

( * ) Notice: Subject to any disclaimer, the term of this patent is extended or adjusted under 35 U.S.C. 154(b) by 0 days.

(21) Appl. No.: 09/464,318

(22) Filed: Dec. 16, 1999

Related U.S. Application Data

(60) Provisional application No. 60/113,060, filed on Dec. 21, 1998.

(51) Int. Cl.[7] ..... E01C 19/22; B05C 17/10

(52) U.S. Cl. ..... 404/118; 15/235.4; 15/235.8

(58) Field of Search ..... 404/114, 118; 15/235.4, 235.8; 37/265, 284, 285

(56) References Cited

U.S. PATENT DOCUMENTS 3,069,713 A * 12/1962 Obraske ..... 15/235.4
4,397,581 A * 8/1983 Jarvis ..... 404/97
4,861,188 A * 8/1989 Rouillard ..... 404/75
5,450,648 A * 9/1995 Dovin et al. ..... 15/235.4
5,540,519 A * 7/1996 Weber ..... 404/102
5,605,415 A * 2/1997 Shamblin ..... 404/118
5,687,448 A * 11/1997 Dye, Jr. ..... 15/235.8
5,727,279 A * 3/1998 Pike, Jr. ..... 15/235.4
5,759,590 A * 6/1998 Cacossa ..... 425/183
5,781,956 A * 7/1998 Kelsay et al. ..... 15/143.1
6,089,787 A * 7/2000 Allen et al. ..... 404/118

* cited by examiner

*Primary Examiner*—Gary S. Hartmann
(74) *Attorney, Agent, or Firm*—George W. Dishong

(57) ABSTRACT

An apparatus for leveling and smoothing concrete and drawing up paste in one motion. The apparatus has a leveling blade with a straight edge and a smooth-surfaced float. The float attaches to the leveling blade by a connecting strip of resilient material, which permits the position of the float to contour to the concrete surface. The connecting strip, adjacent to the float, contacts the concrete surface to pull up cement paste, which creates a more workable surface. The leveling blade attaches to the handle by a mount. The handle and handle mount are adjustable to add additional length to the apparatus for use on various sized concrete surfaces. A device for vibration can also be attached to the apparatus to assist in leveling and smoothing concrete.

9 Claims, 5 Drawing Sheets

APPARATUS FOR LEVELING AND SMOOTHING OF CONCRETE

CROSS-REFERENCE TO RELATED APPLICATIONS

This application claims priority from Provisional Patent Application 60/113,060 filed on Dec. 21, 1998, and entitled APPARATUS FOR LEVELING AND SMOOTHING OF CONCRETE.

STATEMENT REGARDING FEDERALLY SPONSORED RESEARCH OR DEVELOPMENT

Not Applicable.

BACKGROUND OF THE INVENTION

1. Field of the Invention

This invention relates to devices for leveling, smoothing and floating concrete, particularly freshly placed concrete floors. More particularly, this invention relates to an apparatus for leveling, enhancing the mixture, and smoothing freshly placed concrete using a leveling blade, a connecting strip, and an aluminum float. Even more particularly, this invention relates to an apparatus for leveling and smoothing freshly placed concrete in one step by a single operator.

2. Description of the Related Art

There are many tools used today by concrete workers to smooth a surface of concrete. Typical smoothing tools, for example screeds and trowels, allow workers to smooth the surface of freshly poured concrete or similar viscous hardening substance. Concrete-working tools range from the very simple, hand-held variety to complex motorized units that use means for vibrating at least a portion of the tool to aid in settling the concrete. Concrete-smoothing methods can involve such aids as rails constructed along the edges of the concrete project that are fitted with a screed that is moved across the rails. The following patents provide examples of the current art in concrete-working tools and methods.

U.S. Pat. No. 5,727,279 discloses a tool for grading, leveling, and sealing wet concrete. The grading head is triangular, hollow, made of aluminum, floats on top of the wet concrete, and is attached to a long handle. The head is attached to the handle through an attachment block. There are also support members that maintain the head's position with respect to the handle. In this invention, the angle between the leg of the triangular head that accomplishes leveling and the leg that performs the smoothing function cannot be varied to accommodate surface-sensitive smoothing. Also, there is no way to vary the material of which the smoothing surface is constructed, allowing for both drawing up the paste in the mixture and smoothing in one leveling cycle.

U.S. Pat. No. 4,397,581 discloses an aluminum hand trowel/bull float that combines features of grooving, leveling, and smoothing in one tool. The float has a handle that can be lengthened and the angle of the handle with respect to the float can be adjusted so that a worker can level the concrete at close range or from a distance. The moving and shifting of concrete by means of this device in accomplished through front and back "walls" vertically extending from the surface of the float. This device also accommodates weights. As in the previous invention, the angle between the leveling surface and the smoothing surface is constant, and there is no variation of materials possible to accommodate drawing up of paste from the mixture.

U.S. Pat. No. 4,723,869 discloses a semi-rigid, yet flexible, blade assembly made of sheet metal or plastic with a long handle and ribbed reinforcement. This device is intended to be used with weights attached and is designed so that the edges of the blade are allowed to flex vertically during the leveling process. This device is geared for leveling, not smoothing. Leveling and smoothing would be a two-step process using this device. This device cannot accommodate a means for vibration.

U.S. Pat. No. 5,984,571 discloses a vibrating screed that permits selective adjustment of the angle between the axis of a rotatable eccentric and the plane defined by the bottom of the screed plate to vary the relative vertical compaction and horizontal smoothing oscillation movement imparted by the eccentric. The screed includes a frame, motor, an eccentric driven by the motor, a screed plate, and a pair of locking hinges. This device contains a handle-mounted throttle for adjusting the motorized vibration and other automatic features. This device is relatively complex for the one-person cement-leveling job. It allows for changes in horizontal and vertical orientation of the leveling blade, and automatic vibration. This device doesn't accommodate the drawing up of the paste.

U.S. Pat. No. 5,980,154 discloses a manual screeding system for use in leveling freshly poured concrete that includes a frame for providing structural integrity to the screed. The screeding system includes handles, attached to the frame, for manually holding and manipulating the screeding system during the screeding process. A support, attached to the frame, is provided for preventing the screeding system from rotating about the handles during the screeding process. The support is structured to engage the forearms of the user when the screeding system is in use. A pair of bracket assemblies is provided for securely holding a screed board to the frame. This system requires another structure to accomplish leveling and smoothing of the concrete surface, and does not accommodate mixture enhancement as described above. There is no means for vibration possible with this device.

BRIEF SUMMARY OF THE INVENTION

The present invention, in its most simple embodiment, is an apparatus for the leveling and smoothing of concrete floors. The invention levels and smoothes concrete by striking off excess concrete using a leveling blade while simultaneously smoothing the surface with a float that follows the leveling blade while simultaneously drawing up the paste from the concrete mixture.

Preferably, the present invention comprises a leveling blade, a float and a connecting strip. The leveling blade and float connect to three of the four sides of the connecting strip by any form of a means for connecting. The means for connecting may include sheet rock screws, bonding adhesive, and other connecting devices. The leveling blade levels and smoothes concrete by striking off excess concrete. Simultaneously, the float smoothes the surface following the leveling blade and cement paste in the concrete is floated to the surface by a connecting strip having cement-pulling tendency. Resilient properties of the connection between the connecting strip and the leveling blade allow the angle of the smoothing float with respect to the leveling blade to change. This dynamic relationship is important in that the float will remain substantially level with the surface of the concrete and not remain at a fixed angle with respect to the leveling blade.

More preferably, the apparatus also includes a handle attached to the leveling blade that allows the operator to pull the leveling blade forward followed by the float. The handle is mounted directly to the leveling blade or to a mounting bracket connected to the leveling blade. The handle may consist of a single length or include means for extension. The mounting bracket may be of a fixed variety or include means for articulation. The mounting bracket and the handle may be of generally known types in the art.

Most preferably, the present invention is comprised of a leveling blade, a float made of aluminum or rubber, and a handle, with a resilient means of connection between the float and the leveling blade, namely the connecting strip. The connecting strip may be any resilient material including wood, magnesium, rubber, and a variety of plastics, the preferable material having a cement-pulling tendency. The invention does not have to be made of only one particular material and may be constructed of other suitable materials.

One advantage of the present invention is the lightweight construction. The use of durable, lightweight materials such as aluminum allows one person to transport and operate the invention.

Another advantage of the present invention is the multi-function design. In one motion the invention levels the freshly poured concrete leaving a smooth surface. This design includes a leading leveling blade to strike off excess concrete and an aluminum float that follows to level and smooth concrete.

Yet, another advantage of the present invention is one person operation. The lightweight design combined with the multi-function design allows one person to smooth with economy a concrete floor.

Still yet, another advantage of the present invention is the handle that allows the user to operate the level and float at a distance while standing upright. This aspect allows the worker to smooth a greater area in a limited amount of time and permits the worker to stay outside of the poured concrete.

A primary object of the present invention is to provide an apparatus for leveling and smoothing viscous hardening material such as concrete comprising a leveling blade comprising two opposing substantially flat surfaces, a first flat surface and a second flat surface each of which has four edges, and at least one of the four edges is substantially flat lengthwise and makes continuous contact with the material when the apparatus is in use. There is also a means for accommodating a handle on the side of the leveling blade that is nearest the operator. The leveling blade is connected to a smoothing float by means of a connecting strip comprising top, bottom, rear, and front sides, where the rear side is mounted onto the flat surface of the leveling blade that is away from the operator. The connecting strip is attached to the leveling blade by any well-known means for resilient attachment. A smoothing float comprising a first opposing side and a second opposing side is formed around and attached to the top and front sides of the connecting strip by any well-known means for secure attachment. The connecting strip is made of wood, a magnesium-based metal, or other such material that is capable of pulling up paste from a concrete mixture. The second opposing side of the smoothing float comprises a smooth surface that makes continuous contact with the material. The smoothing float can be made of aluminum or other lightweight material. There is also a handle for pulling the leveling blade followed by the smoothing float. The handle comprises proximal and distal ends and a shaft therebetween, the proximal end further comprising a means for matingly attaching that end to the first flat surface, the surface facing the operator, of the leveling blade through the means for accommodating a handle.

Yet another object of the present invention is to provide an apparatus for leveling and smoothing a material such as concrete that can be fitted with a handle that can be adjusted through any length-increasing means to be long enough so that a single user can operate the smoothing device remote without disturbing the already-smoothed material.

Yet another object of the present invention is to provide an apparatus for leveling and smoothing a material such as concrete in which the smoothing float is made of a lightweight material such as aluminum.

Yet still another object of the present invention is to provide an apparatus for leveling and smoothing a material such as concrete in which the handle is connected to the leveling blade as follows. There is a first rectangular sheet that is perpendicularly attached at one lengthwise edge to the side of the leveling blade that isn't attached to the smoothing float, i.e. the side that is facing the operator and that is making first contact with the concrete. There is a second rectangular sheet that is folded lengthwise across the lengthwise edge that isn't connected to the leveling blade. That second sheet straddles the midpoint of the lengthwise edge over which it is folded. Finally there is an opening in substantially the middle of the second sheet for accepting one end of the handle in rigid attachment therebetween.

Yet still another object of the present invention is to provide an apparatus for leveling and smoothing a material such as concrete in which the handle is connected by a mounting bracket connected directly to the operator-facing side of the leveling blade.

Yet still another object of the present invention is to provide an apparatus for leveling and smoothing a material such as concrete in which there is a vibrating means attached to the surface of the leveling blade that faces the operator.

These and further objects of the present invention will become apparent to those skilled in the art after a study of the present disclosure of the invention.

DETAILED DESCRIPTION OF THE INVENTION

Figure 1:
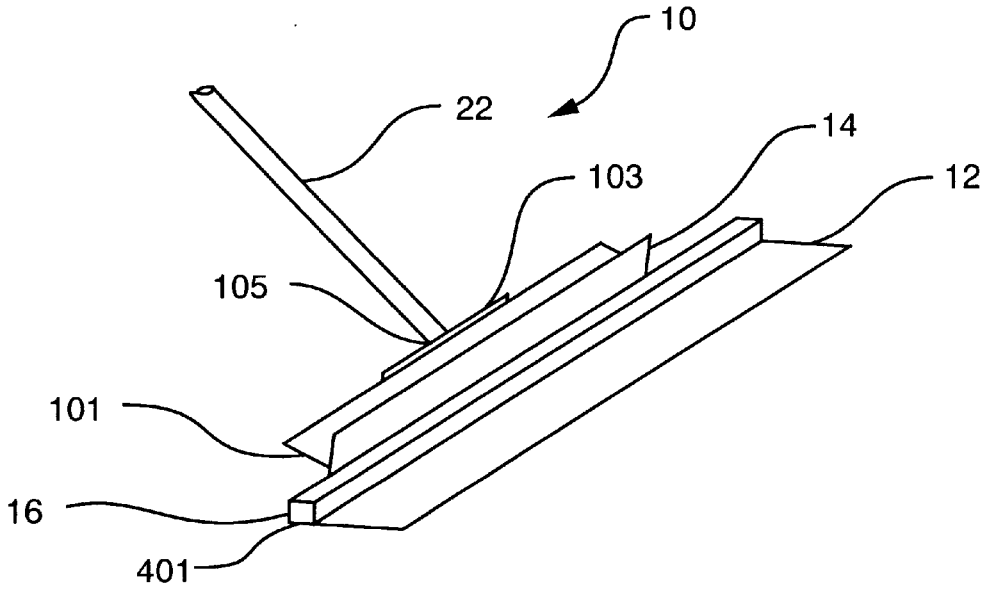
FIG. 1 is a perspective view of the leveling and smoothing apparatus.
Figure 2:
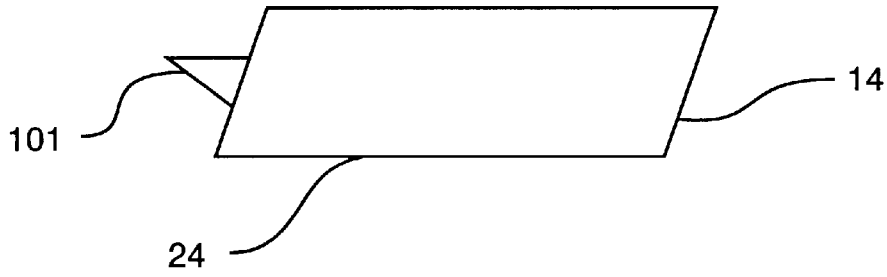
FIG. 2 is a perspective view of the leveling blade with toothed edge and handle connection means shown.

Referring to FIG. 1, apparatus 10 comprises smoothing float 12, leveling blade 14, connecting strip 16, and handle 22. Leveling blade 14 comprises blade 24 on one edge of rectangle 14, in the preferred embodiment and as shown in FIG. 2. Connecting strip 16, in the preferred embodiment made of wood or a magnesium-based metal, joins float 12 to leveling blade 14 through connecting means 18, depicted in FIG. 4 which, in the preferred embodiment is a plurality of sheet-rock screws. Connecting means 18 must be of a type that allows angle 610 between leveling blade 14 and connecting strip 16 to vary during operation so that float 12 remains flush against the concrete surface being leveled. In the preferred embodiment, connecting strip 16 is joined to float 12 either with a bonding material or other fasteners, e.g. screw 118.

Figure 3:
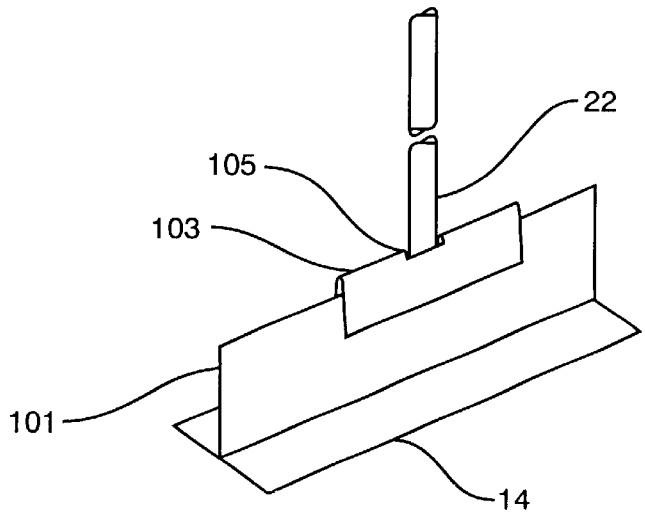
FIG. 3 is a perspective view of the leveling blade with handle connection means and handle shown.

Handle 22 can be connected to leveling blade 14 through a combination of attached strip 101, mounting strip 103, and handle attachment means 105 as shown in FIG. 3. Handle 22 can also be connected to leveling blade 14 by means of mounting bracket 20 shown in FIGS. 4–7.

Figure 4:
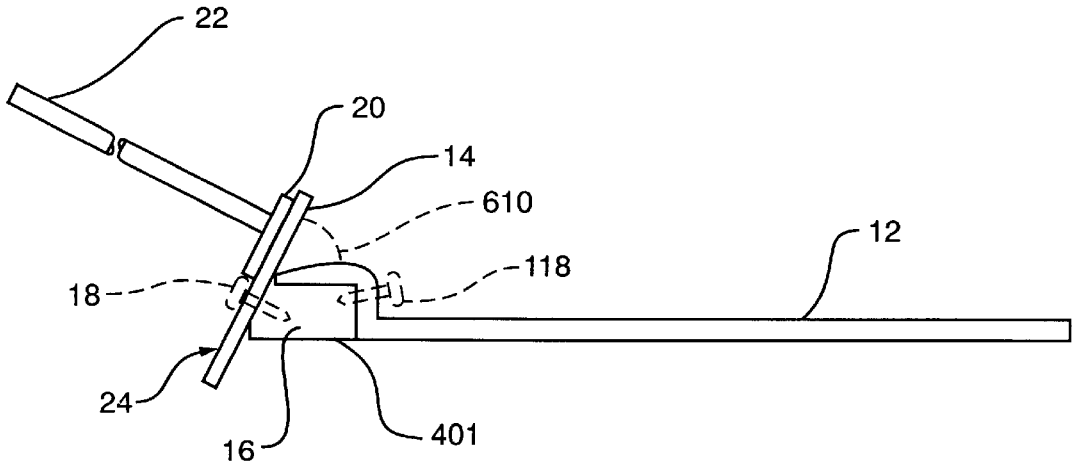
FIG. 4 is a side view of the leveling and smoothing apparatus with connection means between the leveling blade and the connecting strip shown.
Figure 5:
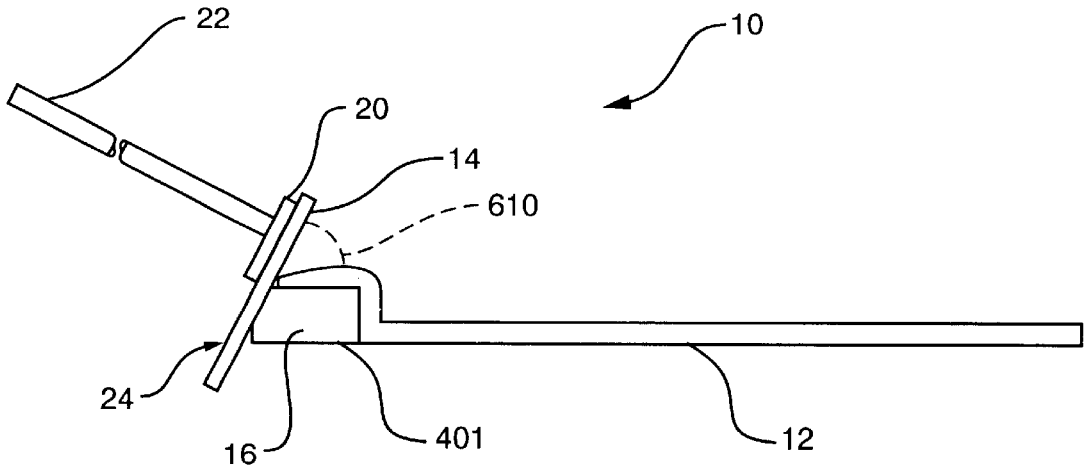
FIG. 5 is a side view of the leveling and smoothing apparatus showing an operational orientation of the leveling blade, i.e. at an acute angle with respect to the smoothing float.

When handle 22 is pulled, leveling blade 24 scrapes away any excess viscous material such as concrete and creates a level surface. Following leveling blade 24, float 12 acts as a trowel to smooth the level surface created by blade 24. The resilient properties of connecting strip 16 joining leveling blade 14 to float 12 allow the angle of float 12 with respect to leveling blade 14 and handle 22 to vary depending on the surface over which float 12 is pulled, allowing float 12 to remain substantially flat with respect to the surface being smoothed while dynamic forces act on leveling blade 24 and handle 22 as apparatus 10 is moved across the surface. Downwardly exposed portion 401 of connecting strip 16 as shown in FIGS. 4–6 may additionally create a reaction that pulls up paste from the concrete mixture and provides a more workable surface.

Figure 8A:
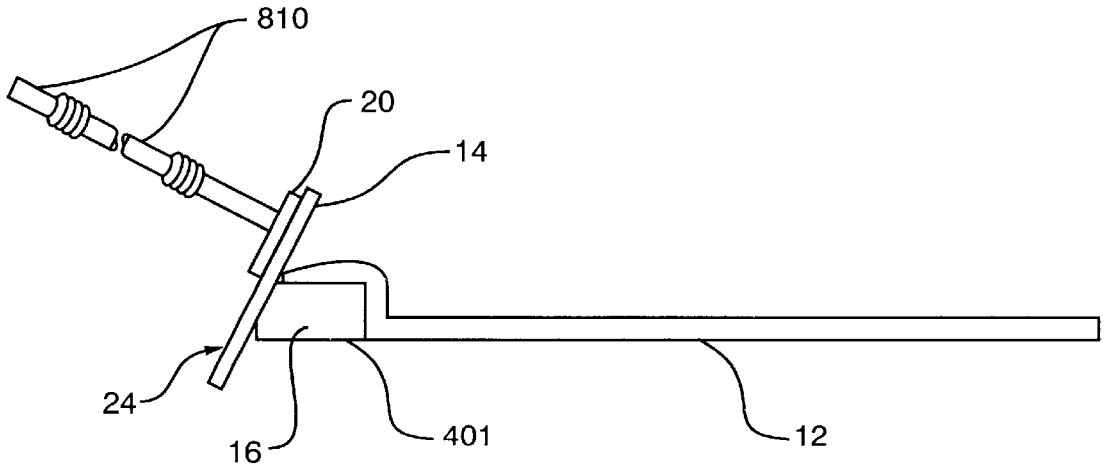
FIGS. 8A and 8B depict views of the extendable and articulated handle, respectively.
Figure 8B:
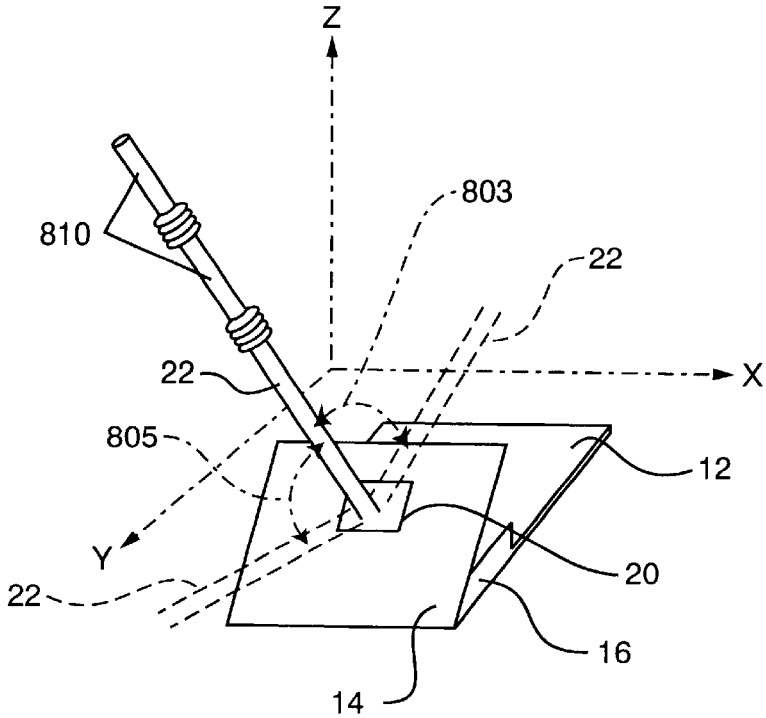

Additional handle extensions 810 as shown in FIG. 8A may be added to handle 22 to permit the operator to extend the invention further into the concrete working area while not stepping on the freshly-poured concrete. Handle 22 can be of a variety that articulates with respect to mounting bracket 20 to permit—vertical angle 805, and horizontal angle 803, as shown in FIG. 8B or both vertical and horizontal articulation.

Figure 6:
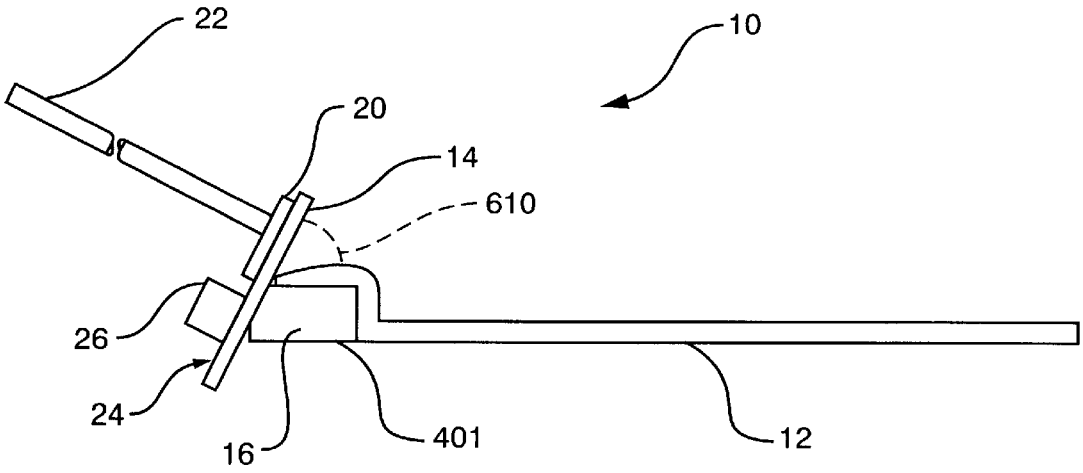
FIG. 6 is a side view of the leveling and smoothing apparatus showing a vibrating means positioned on the shaft of the handle.
Figure 7:
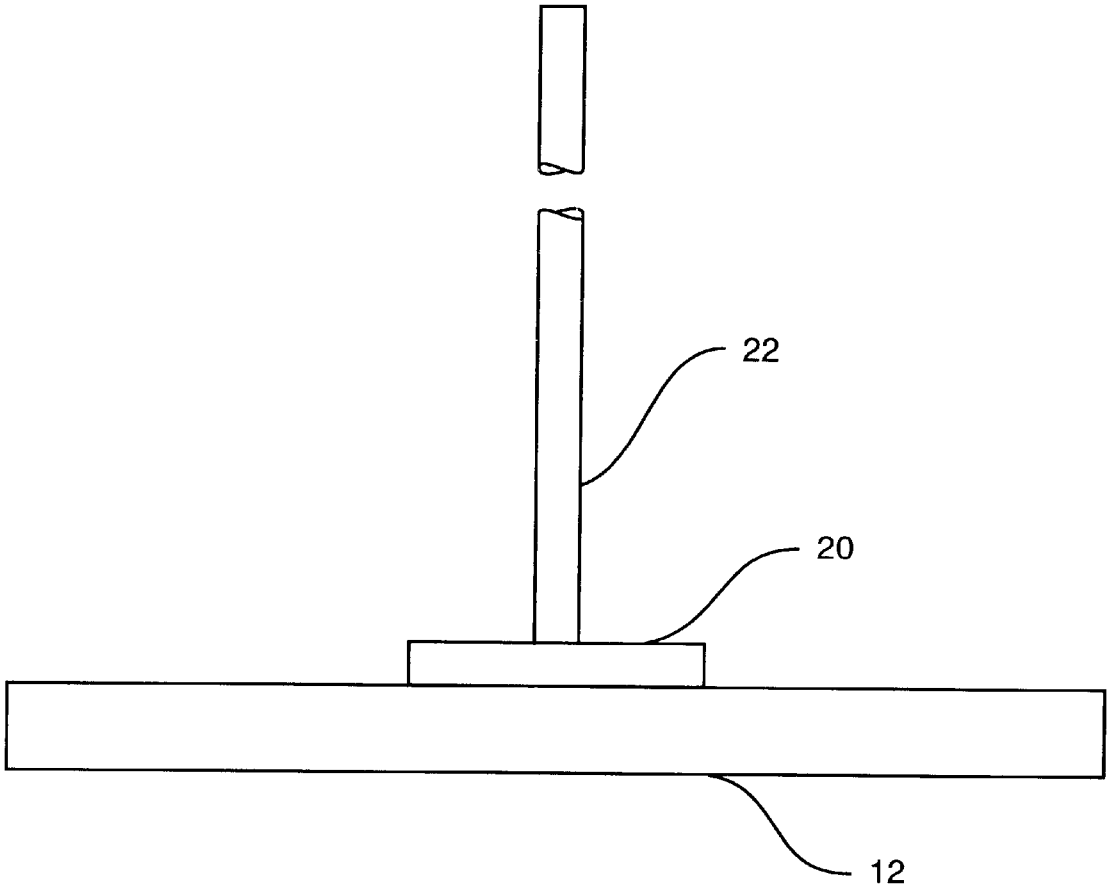
FIG. 7 is a plan view showing the handle directly connected by mounting bracket to the leveling blade.

Referring now to FIG. 6, another embodiment includes means for vibration 26 used to aid in leveling and smoothing concrete. Means of vibration 26 may be any commonly known in the art. In the preferred embodiment, means for vibration 26 is powered by either a DC battery or AC electrical wire. As shown in FIG. 6, in the preferred embodiment, means for vibration 26 is mounted on leveling blade 24 near handle attachment 20.

The preferred embodiments were described to provide the best illustration of the principles of the invention, but not to limit modifications allowed under this description and claims. The disclosure of the preferred embodiments enables one of ordinary skill in the art to use the invention with various modifications. All such modifications and variations are within the scope of the invention as determined by the appended claims.

I claim:

1. An apparatus for leveling and smoothing comprising:

a leveling blade comprising two opposing substantially flat surfaces, a first flat surface and a second flat surface each said two opposing substantially flat surfaces having four edges, at least one of said at least four edges being substantially flat lengthwise, and means for accommodating a handle;

a connecting strip comprising top, bottom, rear, and front sides, said rear side mounted onto said second flat surface of said leveling blade;

a first means for securely attaching said second flat surface of said leveling blade to said rear side of said connecting strip;

a smoothing float comprising a first opposing side and a second opposing side, said first opposing side being formed around and attached to said top and front sides of said connecting strip by a means for attaching said smoothing float, the second said opposing side comprising a smooth surface;

a second means for securely attaching said top and front sides of said connecting strip to said first opposing side of said smoothing float;

a handle for pulling said leveling blade followed by said smoothing float, said handle comprising proximal and distal ends, said proximal end further comprising a means for matingly attaching said proximal end to said first flat surface of said leveling blade through said means for accommodating a handle;

a first rectangular sheet with two lengthwise edges, said first rectangular sheet attached at one of said two lengthwise edges in substantially a perpendicular orientation to said first flat surface of said leveling blade;

a second rectangular sheet folded lengthwise across the other lengthwise edge of said first sheet straddling the midpoint of said other lengthwise edge; and an opening in substantially the middle of said second sheet for accepting said proximal end of said handle in rigid attachment therebetween.

2. The apparatus as in claim 1 wherein said handle further comprises a means for increasing the length of said handle shaft.

3. The apparatus as in claim 1 wherein said smoothing float is made of aluminum.

4. The apparatus as in claim 1 wherein said connecting strip is made of wood.

5. The apparatus as in claim 1 wherein said connecting strip is made of magnesium.

6. The apparatus as in claim 1 wherein said handle further comprises a means for articulation of the handle shaft.

7. The apparatus as in claim 1 further comprising a means for vibrating wherein said means for vibrating is attached to said first flat surface of said leveling blade.

8. The apparatus as in claim 1 wherein said first means for securely attaching is screws.

9. The apparatus as in claim 1 wherein said second means for securely attaching is screws.

* * * * *